US008257633B2

(12) United States Patent
Sindt et al.

(10) Patent No.: US 8,257,633 B2
(45) Date of Patent: Sep. 4, 2012

(54) ROTOR OF PROGRESSIVE CAVITY APPARATUS AND METHOD OF FORMING

(75) Inventors: Olivier Sindt, Cheltenham (GB); Michael Shepherd, Stroud (GB); Hossein Akbari, Stoke Gifford (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 1257 days.

(21) Appl. No.: 11/740,978

(22) Filed: Apr. 27, 2007

(65) Prior Publication Data

US 2008/0264593 A1 Oct. 30, 2008

(51) Int. Cl.
*B22D 19/00* (2006.01)

(52) U.S. Cl. ..... 264/299; 264/271.1; 264/279.1; 264/272.11; 264/294; 264/234; 264/629; 264/632; 264/328.1; 264/328.3; 264/334; 264/337; 264/338

(58) Field of Classification Search ..... 264/299, 264/271.1, 279.1, 272.11, 294, 234, 629, 264/632, 328.1, 328.3, 334, 337, 338
See application file for complete search history.

(56) References Cited

U.S. PATENT DOCUMENTS

| | | | | |
|---|---|---|---|---|
| 1,892,217 | A | 12/1932 | Moineau | |
| 3,646,185 | A | 2/1972 | Jennings | |
| 4,761,124 | A * | 8/1988 | Timuska et al. | 418/153 |
| 5,219,499 | A * | 6/1993 | Timuska | 264/46.4 |
| 5,310,320 | A * | 5/1994 | Timuska | 416/241 R |
| 5,780,166 | A * | 7/1998 | Lund | 428/472.1 |
| 6,578,251 | B2 * | 6/2003 | Kliman et al. | 29/596 |
| 6,849,220 | B1 * | 2/2005 | Sundstrom et al. | 264/273 |
| 6,872,061 | B2 * | 3/2005 | Lemay et al. | 418/48 |
| 6,944,935 | B2 * | 9/2005 | Hache | 29/598 |
| 7,442,019 | B2 * | 10/2008 | Kaiser et al. | 418/153 |
| 2002/0192093 | A1 | 12/2002 | Gantenhammer | |
| 2004/0126257 | A1 * | 7/2004 | Lemay et al. | 418/48 |
| 2006/0029507 | A1 * | 2/2006 | Kaiser et al. | 418/48 |
| 2006/0216178 | A1 * | 9/2006 | Sindt et al. | 418/45 |

FOREIGN PATENT DOCUMENTS

| | | |
|---|---|---|
| DE | 1816462 | 7/1970 |
| DE | 2707901 A1 | 8/1978 |
| FR | 2851018 | 8/2004 |
| GB | 1306352 | 2/1973 |
| GB | 1353292 | 5/1974 |
| JP | 01301250 | 12/1989 |
| JP | 2004351446 | 12/2004 |

* cited by examiner

*Primary Examiner* — Christina Johnson
*Assistant Examiner* — Saeed Huda
(74) *Attorney, Agent, or Firm* — Jeremy Welch

(57) ABSTRACT

Cast material rotor (200,300,500,800) with profiled helical outer surface (208,308,508,808). Cast material layer (502, 802) can be disposed between core (504,804) and tube (506, 806). Profiled helical outer surface (208,308) can be in tube 206 or cast material layer 302, respectively. Method of forming rotor 200 can include filling void between outer surface 212 of core 204 and longitudinal bore 210 of tube 206 having profiled helical outer surface 208 with cast material 202 in fluid state, and solidifying cast material 202. Tube 206 can be disposed within profiled helical bore 714 of mold 700, e.g., before solidifying cast material 202. Method of forming rotor 300 can include filling void between outer surface 312 of core 304 and profiled helical bore 714 in mold 700 with cast material 302 in fluid state, solidifying cast material 302 to impart profiled helical outer surface 308 thereto, and removing mold 700 from cast material 302.

93 Claims, 4 Drawing Sheets

ROTOR OF PROGRESSIVE CAVITY APPARATUS AND METHOD OF FORMING

BACKGROUND

The invention relates generally to rotors for use with progressive cavity pumps or motors; more specifically, to a cast material rotor and method of forming a rotor.

Progressive cavity pumps or motors, also referred to as progressing cavity pumps or motors, typically include a power section 100, as shown in prior art FIG. 1 attached hereto, consisting of a rotor 101 having a profiled helical outer surface 103 disposed within a stator 105 having a profiled helical inner surface 107. Although stator 105 is shown with a profiled helical outer surface 111, progressive cavity apparatuses are not so limited, for example, the outer surface can be cylindrical if desired. The rotor and stator of a progressive cavity apparatus operate according to the Moineau principle, originally disclosed in U.S. Pat. No. 1,892,217. A rotor can have one less lobe than a stator.

In use as a pump, relative rotation is provided between the stator and rotor by any means known in the art, and a portion of the profiled helical outer surface of the rotor engages the profiled helical inner surface of the stator to form a sealed chamber or cavity. As the rotor turns eccentrically within the stator, the cavity progresses axially to move any fluid present in the cavity.

In use as a motor, a fluid source is provided to the cavities formed between the rotor and stator. The pressure of the fluid causes the cavity to progress and imparts a relative rotation between the stator and rotor. In this manner fluidic energy can be converted into mechanical energy.

If a progressive cavity pump or motor relies on a seal between the stator and rotor surfaces, at least one of the active surfaces can include a resilient or dimensionally forgiving material. An interference fit between the rotor and stator can be achieved if at least one of the rotor or the stator interface surfaces includes a resilient material. A resilient material can allow operation of the power section with a fluid containing solid particles as the solids can be temporarily embedded in the resilient material at the sealing interface of the active surfaces of a rotor and stator. The resilient material is frequently a layer of elastomer, which can be relatively thin or thick, disposed in the interior surface of the stator and/or on the exterior surface of a rotor. A stator or rotor with a thin elastomeric layer is generally referred to as thin wall or even wall design.

A rotor can be made of non-compliant material, for example, metal, and/or can be made of a non-compliant material body with a resilient material (e.g., elastomer) on the profiled helical outer surface of the body.

SUMMARY OF THE INVENTION

In one embodiment, a method of forming a rotor can include providing a mold with a profiled helical bore, disposing a core within the profiled helical bore, filling a void between an outer surface of the core and the profiled helical bore in the mold with a cast material in a fluid state, solidifying the cast material to impart a profiled helical outer surface into the cast material, and removing the mold from the cast material. Solidifying can include curing, for example, application of heat, radiation, and/or pressure. Solidifying can include the passage of time. Solidifying can refer to obtaining a solid state, which can also be resilient. The core can be substantially the same length as the profiled helical bore of the mold. Core can be disposed longitudinally within the profiled helical bore. Rotor can be a rotor of a progressive cavity apparatus. Removing the mold can include removing an assembly of the cast material and the core from the mold. Core and mold can be substantially coaxial. Rotor mold can be a negative mold, as is known in the art. Core can be solid or hollow, e.g., have a longitudinal bore.

Method of forming a rotor can include applying a release agent to the profiled helical bore in the mold before filling the void with the cast material. The removing step can include threading an assembly of the cast material and the core out of the profiled helical bore in the mold to remove the assembly from the mold. The mold can be a single piece, e.g., not radially divisible. Alternatively, the rotor mold can be multiple pieces, for example, a plurality of longitudinally divided sections. The step of providing the mold with the profiled helical bore can include forming the mold. Forming the mold can include disposing a first body with a profiled helical outer surface into a longitudinal bore of a second body, filling a void between the profiled helical outer surface of the first body and the longitudinal bore of the second body with a second cast material in a fluid state, solidifying the second cast material to impart the profiled helical bore into the second cast material, and removing the first body from the profiled helical bore in the second cast material to create the mold with the profiled helical bore.

First and second cast materials can be different or the same material(s). Second cast material can be a resin or a polyurethane. Resin can be an epoxy. A release agent can be applied to the profiled helical outer surface of the first body before filling the void between the profiled helical outer surface of the first body and the longitudinal bore of the second body with the second cast material. The first body used to form the mold can be an existing rotor. Method of forming a rotor can include imparting pressure on the cast material during and/or after filling the void. Pressure can be applied to opposing ends of the cast material, for example, to dispose the cast material into the mold. End cap can be included to seal an open end of the mold. Solidifying the cast material can include applying heat, pressure, and/or radiation to the cast material. The step of solidifying the cast material can adhere the cast material to the core. Method of forming a rotor can include coating the profiled helical outer surface in the cast material with a metal, e.g., chrome, and/or a resilient material.

An outer surface of the core can have a circular or non-circular transverse cross-section. An outer surface of the core can have at least one protuberance, e.g., to help form an interlock with the cast material. Core can be a metal and/or a polymer, for example A polymer can be a thermosetting polymer, for example, vulcanized rubber or another polymer which once formed and cured, can not be remelted and remolded. A polymer can be a thermoplastic polymer, for example, polyetheretherketone (PEEK), nylon, polytetrafluoroethylene (PTFE), or liquid crystal polymer (LCP). Method of forming a rotor can include selecting a polymer having a glass transition temperature above an operating temperature of the rotor.

In another embodiment, a method of forming a rotor can include providing a tube having a longitudinal bore and a profiled helical outer surface, disposing a core within the longitudinal bore of the tube, filling a void between an outer surface of the core and the longitudinal bore of the tube with a cast material in a fluid state, and solidifying the cast material. Solidifying the cast material can adhere the cast material to the core and the tube. Solidifying can include curing, for example, application of heat, radiation, and/or pressure. Solidifying can include the passage of time.

Method of forming a rotor can include imparting pressure on the cast material during and/or after filling the void. Pressure can be applied to opposing ends of the cast material, for example, to dispose the cast material into the mold. End cap can be included to seal an open end of the mold. Solidifying the cast material can include applying heat, pressure, and/or radiation to the cast material. Tube can be a resilient material, a polymer, and/or a metal. Core can be a resilient material, a polymer, and/or a metal. Outer surface of the core can have a circular or non-circular transverse cross-section. Outer surface of the core and/or longitudinal bore of tube can have at least one protuberance, for example, to aid in retention to the cast material.

Method of forming a rotor can include disposing the tube within a profiled helical bore of a mold before solidifying the cast material, the profiled helical bore in the mold having a substantially similar form to the profiled helical outer surface of the tube. Method of forming a rotor can include imparting pressure on the cast material after filling the void and/or disposing the tube within the profiled helical bore in the mold.

In yet another embodiment, a method of forming a rotor can include inserting a tube having a longitudinal bore and an outer surface into a mold with a profiled helical bore, conforming the outer surface of the tube to the profiled helical bore in the mold, disposing a core within the longitudinal bore of the tube, filling a void between an outer surface of the core and the longitudinal bore of the tube with a cast material in a fluid state, solidifying the cast material, and removing the mold from the tube to expose a profiled helical outer surface of the tube. Tube can be selected to have dimensions corresponding to desired dimensions of a completed rotor.

Outer surface of the tube can have a circular or non-circular transverse cross-section before the conforming step. Step of conforming the outer surface of the tube to the profiled helical bore in the mold can include hydroforming the tube to the profiled helical bore in the mold. Step of filling the void with the cast material in the fluid state can conform the outer surface of the tube to the profiled helical bore in the mold, e.g., pressurization of the tube. Step of conforming the outer surface of the tube to the profiled helical bore in the mold can include twisting and imparting axial compression to the tube. Step of conforming the outer surface of the tube to the profiled helical bore in the mold can include pulling suction between the outer surface of the tube and the profiled helical bore in the mold. Step of solidifying the cast material can adhere the cast material to the outer surface of the core and the longitudinal bore of the tube. Solidifying can retain the profiled helical form in the outer surface in the tube.

A release agent can be applied to at least one of the profiled helical bore in the mold and the outer surface of the tube, e.g., before conforming the outer surface of the tube to the profiled helical bore in the mold. Pressure can be imparted on the cast material before, during, and/or after filling the void or solidifying. Solidifying the cast material can include applying heat to the cast material. A maximum diameter of the outer surface of the tube can be less than a minimum diameter of the profiled helical bore in the mold before the conforming step. A maximum diameter of the outer surface of the tube can be greater than a minimum diameter of the profiled helical bore in the mold before the conforming step. A peripheral length of the outer surface of the tube can be substantially similar to or slightly less than a peripheral length of the profiled helical bore in the mold. The peripheral length can be uniform along a length of the rotor. Outer surface of the core can have at least one protuberance.

Core can be any material. Tube can be any material. Tube can be a resilient material. Resilient material tube can be at least partially uncured, for example, before the solidifying step. Solidifying cast material can include applying heat to the cast material and/or the at least partially uncured resilient material. Heat can cure the at least partially uncured resilient material. Method of forming a rotor can include curing the resilient material before removing the mold from the tube.

In another embodiment, a rotor of a progressive cavity apparatus can include a core, and a cast material layer disposed on the core, the cast material layer having a profiled helical outer surface. Rotor can include a coating of resilient material and/or chrome or any other metal on the profiled helical outer surface. Core can have a circular and/or non-circular transverse cross-section. Outer surface of the core can have at least one protuberance. A longitudinal axis of the core can be coaxial to a longitudinal axis of the cast material layer. Core can be metal and/or a polymer. Polymer can be a thermoplastic polymer or a thermosetting polymer. Polymer can have a glass transition temperature above an operating temperature of the rotor.

In yet another embodiment, a rotor of a progressive cavity apparatus can include a tube with a profiled helical outer surface and a longitudinal bore, a core disposed within the longitudinal bore of the tube, and a cast material layer between the longitudinal bore of the tube and an outer surface of the core. Cast material layer can adhere to the longitudinal bore of the tube and/or the outer surface of the core. Longitudinal bore of the tube and/or the outer surface of the core can be adhered to the cast material layer, for example, with a bonding agent. Profiled helical outer surface of the tube can include a coating of resilient material and/or chrome or any other metal on the profiled helical outer surface of the tube. Tube can be a resilient material tube. Outer surface of core can have a circular and/or non-circular transverse cross-section. Longitudinal bore of the tube can have a circular and/or non-circular transverse cross-section. Longitudinal bore of the tube and/or outer surface of the core can have at least one protuberance. A longitudinal axis of the core can be coaxial to a longitudinal axis of the tube. Core can be metal. Tube can be metal. Cast material layer can be a polymer, fore example, a thermoplastic or thermosetting polymer. Cast material can have a glass transition temperature above an operating temperature of the rotor. Cast material layer can be an elastomer.

DETAILED DESCRIPTION OF THE INVENTION

Figure 1:
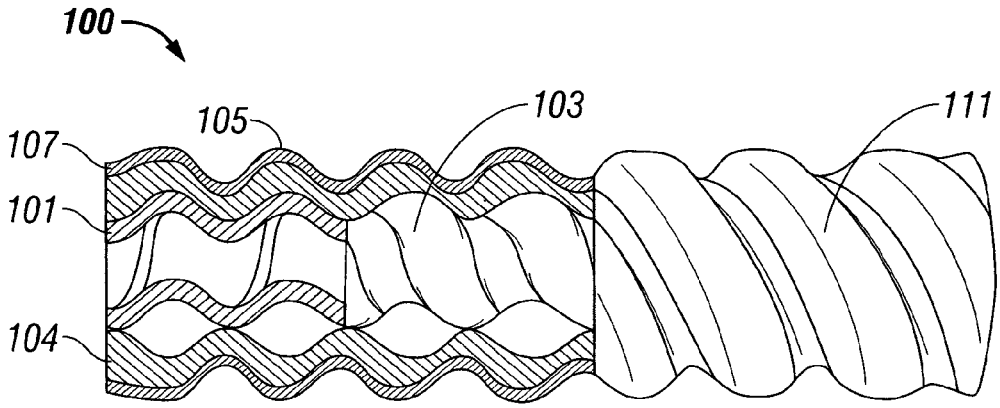
FIG. 1 is a cross-sectional view of a prior art power section that includes a rotor with a profiled helical outer surface disposed within a profiled helical bore of a stator lined with a layer of resilient material.

Prior art FIG. 1, discussed in the background section above, is a power section 100 of one embodiment of a progressive cavity apparatus. Power section 100 includes a rotor 101 with a profiled helical outer surface disposed within a profiled helical bore of a stator 105 lined with a layer of resilient material 109. The term profiled shall refer to a substantially non-circular transverse cross-section, for example, a lobed (e.g., a plurality of lobes) or corrugated cross-section of a rotor (e.g., FIGS. 2 and 7) for use as a power section of a progressive cavity apparatus. Profiled helical outer surface of a rotor can have a uniform pitch of the helix along a longitudinal length of a rotor. Profiled helical outer surface of a rotor can have a relatively long pitch length (i.e., the axial distance of one 360-degree helical turn of one lobe), for example, a pitch length between two to twenty times that of the major diameter. Although illustrated in reference to rotors of progressive cavity apparatuses, a rotor can be utilized in other apparatuses without departing from the spirit of the invention.

Figure 2:
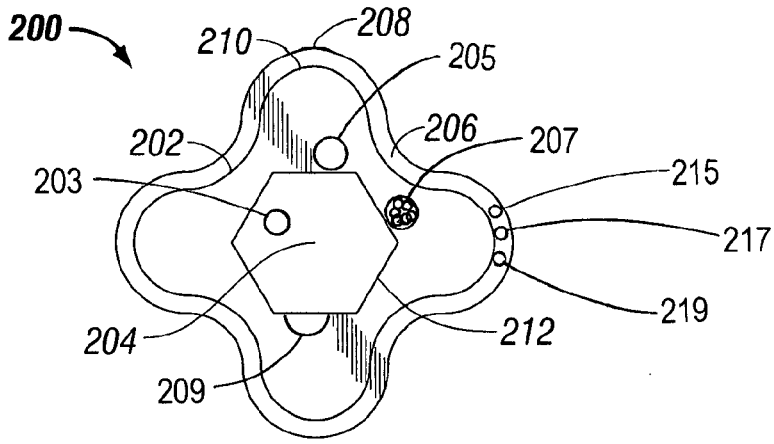
FIG. 2 is a perspective end view of a rotor having a cast material layer between a core and a tube, according to one embodiment of the invention.
Figure 6:
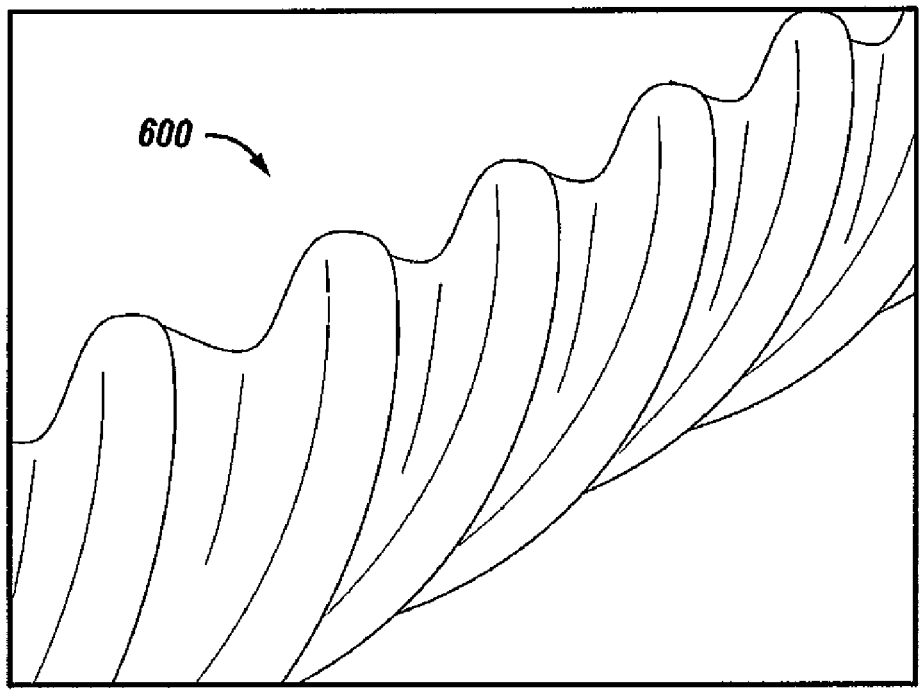
FIG. 6 is a perspective view of a profiled helical outer surface of a rotor, according to one embodiment of the invention.

FIG. 2 is a perspective end view of a rotor 200 having a cast material layer 202 between a core 204 and a tube 206, according to one embodiment of the invention. Rotor 200, which can be a rotor of a progressive cavity apparatus, depicted in FIG. 2 has four lobes, however a rotor can have any number of lobes. Tube 206 can have a profiled helical outer surface 208, for example, as shown in FIG. 6. Tube 206 can have a profiled helical inner surface 210 or a non-profiled and/or non-helical inner surface (not shown). For example, inner surface 210 of tube 206 can be a cylindrical longitudinal bore. Inner surface 210 (e.g., longitudinal bore) of tube 206 can have a circular transverse cross-section or a non-circular transverse cross-section, e.g., the profiled cross-section shown in FIG. 2. Outer surface 208 of tube 206 can be the active surface of the rotor 200. Outer surface 208 of tube 206 can be coated with a material, if desired. Outer surface 208 of tube 206 can be coated with metal, (e.g., chrome, gold, silver, copper, cadmium, nickel, zinc, lead, tin, or bronze) or another material (e.g., a resilient material coating), by dipping, spraying, plating, electro-deposition, etc.

Tube 206 can be any material or materials. For example, tube 206 can be a metal or a polymer. Tube 206 can be a thin metal tube. Tube 206 can be a metal such as steel, stainless steel, aluminum, titanium, or a combination thereof. In one embodiment, tube 206 can be a resilient material. Resilient material can be an elastomer, for example, rubber. A resilient material can have a hardness of less than about 90 durometer or a hardness in the Shore A scale. A resilient material can be any suitable for the working conditions of the rotor (e.g., temperature, pressure, chemicals, entrained borehole cuttings, etc.). Non-limiting examples of elastomers which can be considered for downhole progressive cavity use are fluoroelastomer (e.g., VITON fluoroelastomers), hydrogenated nitrile rubber (HNBR), nitrile rubber (NBR), synthetic rubber, or natural rubber. Elastomer used can be fully cured, fully uncured, or at least partially uncured, e.g., pliable. A resilient material tube can be homogenous, composite, fiber reinforced, mesh reinforced, and/or formed from layers of different material, which can include at least one non-resilient layer. In one embodiment, the outer surface of a resilient material tube is resilient; however the inner surface of a resilient material tube can be resilient or even non-resilient and still be considered a resilient material tube as used herein.

In the embodiment in FIG. 2, tube 206 has a core 204 disposed within the longitudinal bore 210 of the tube 206. A longitudinal axis of core 204 can be coaxial or parallel to a longitudinal axis of the tube 206, but is not required. Core 204 can be solid (as shown) or hollow. Outer surface 212 of core 204 can have any cross-section, for example, the cross-section transverse to the longitudinal axis of the core 204. Outer surface 212 of core 204 can be non-helical (e.g., as in FIG. 4). Outer surface 212 of core 204 can have a circular transverse cross-section or a non-circular transverse cross-section (e.g., the hexagonal transverse cross-section shown in FIGS. 2-5). Non-circular transverse cross-section can be ovate, a closed figure including curved and straight line segment(s), triangular, rectangular, square, hexagonal, or other polygonal. Core 204 can add axial and/or rotational strength to the rotor 200. Core 204 can be used to transmit torque to and/or from the rotor 200, for example when rotor 200 is operably disposed in the profiled helical bore of a stator of a progressive cavity apparatus.

In FIG. 2, cast material layer 202 is disposed between the outer surface 212 of the core 204 and the longitudinal bore 210 of the tube 206. Cast material layer 202 can be fully circumferential to the core 204, as shown. Cast material can be any material suitable for use in a progressive cavity apparatus. Cast material layer 202 can be a single layer or multiple concentric layers of differing or similar cast materials. Cast material can be an amorphous alloy. Cast material can be a polymer. Cast material can be a molded polymer, for example a polymer injected under pressure, as discussed below in reference to the formation of a rotor. Cast material can be a thermosetting material, e.g., a thermosetting polymer. Thermosetting polymer can solidify, e.g., cure, from a fluid or uncured state through the addition of energy. The energy can be heat, a chemical reaction (e.g., a two-part epoxy), radiation, and/or high pressure steam, or any combination of these, for example. Any polymer can be used, for example, but not limited to, a resin (e.g., epoxy), polyurethane, phenolic resins, poly imides, etc. A resin can be a thermosetting or thermoplastic resin.

One non-limiting example of a resin is the High Temperature Mould Maker (C-1) liquid epoxy by Devcon U.K., which is rated for use up to 260° C. (500° F.). Cast material can be a metal filled, ceramic filled, and/or fiber filled epoxy, e.g., polymeric fibers, glass fibers, carbon fibers, etc. Non-limiting examples of metal filled resins are those commonly known as liquid metal resins and are produced by ITW Devcon in the United States and Freeman Mfg. & Supply Co. in the United Kingdom, for example. Non-limiting examples of metal fillers which can be utilized are steel, stainless steel, aluminum, and/or titanium. One non-limiting example of a fiber filled epoxy is a polycarbon fiber ceramic filled Novolac™ resin by Protech Centreform (U.K.) Ltd. that remains stable up to 240° C. (460° F.). Metal fillers or other heat conducting materials can be added if desired to conduct heat, for example, heat generated at the outer surface 208 of the rotor 200 to the core 204 to aid in cooling.

Cast material can be a thermoplastic polymer, including, but not limited to, polyethylene, polypropylene, polyetheretherketone (PEEK), polyphenylene sulfide (PPS), nylon, polytetrafluoroethylene (PTFE), liquid crystal polymer (LCP), or any high temperature suitable polymer(s). In one embodiment, the cast material is selected to be solid and stiff, for example, working below its glass transition temperature when the rotor is used at operating temperature. Operating temperature can be the temperature of the fluid disposed through the progressive cavity apparatus and/or the heat created from the operation of the progressive cavity apparatus (e.g., friction). Cast material can be compliant, non-compliant, or any hardness desired. Cast material can be selected based on the fluid, which can include entrained particles such as drill bit cuttings, contacting the rotor during use in a progressive cavity apparatus. Cast material can be selected based on any temperature exposure requirements, for example, the downhole fluid temperature. Cast material layer 202 can self-adhere (e.g., bond) to the outer surface 212 of core 204 and/or to the inner surface (e.g., longitudinal bore) 210 of tube 206. Cast material layer 202 can be connected to the outer surface 212 of core 204 and/or to the inner surface (e.g., longitudinal bore) 210 of tube 206 by a bonding agent, (e.g., a primer) and/or adhesive, as discussed further below. Outer surface 212 of core 204 and/or the inner surface (e.g., longitudinal bore) 210 of tube 206 can include at least one protuberance, for example, to serve as a mechanical interlock with the solidified cast material layer 202.

As shown in FIG. 2, a conduit 205, conductor 207, and/or pathway 209 can be included in the cast material layer 202, e.g., cast into the void between the core 204 and the tube 206. Although all three cast elements (205, 207, 209) are shown in FIG. 2, a single type of cast element can be present, either alone or in plurality. A conduit 205 and/or pathway 209 can be used for passing a conductor and/or fluids. A conduit 205 and/or pathway 209 can also be used as means for control and/or communication, for example, pressure pulses. A conductor 207, which can include an optical fiber and/or an electrical conductor, can be permanently embedded in the cast material 310. A sheathed conductor can be embedded in the cast material layer 202. Although illustrated in FIG. 2 with multiple strands, a conductor 207 can be at least one strand without departing from the spirit of the invention.

A conductor, independent of the presence of an embedded conductor 207, can also be inserted into a conduit 205 or pathway 209 to allow future removal and/or refurbishment. To add a conduit 205 and/or conductor 207 to the rotor 200 disclosed herein, a conduit 205 and/or conductor 207 can be disposed in the void between an outer surface 212 of the core 204 and the longitudinal bore 210 of the tube 206 before the cast material is added. In one embodiment, conduit(s) 205 and/or conductor(s) 207 can be disposed therebetween after the cast material is added, but before the cast material is fully cured. To aid in the bonding of the conduit 205 and/or conductor 207 to the cast material, a bonding agent and/or surface roughing method can be applied to the exterior surface of the conduit 205 and/or conductor 207.

A pathway 209 can be formed in the cast material layer 202. As used herein, the term pathway shall refer to a passage that allows fluid to flow therethrough or allows the disposition of other objects, for example, an electrical conductor or conduit, therethrough. To form a pathway 209, a mandrel (e.g., a tube or rod) can be disposed in the void between the outer surface 212 of the core 204 and the longitudinal bore 210 of the tube 206. A mandrel can have a non-stick outer surface by material choice, for example, silicone rubber, or by applying a non-stick coating, for example, silicone gel. The mandrel can be removed after the cast material is at least substantially cured to leave behind a pathway 209.

Any number of cast elements, for example, conduit 205, conductor 207, and/or pathway 209 that physically fit in the void can be embedded into the cast material layer 202. Cast elements are not required to be evenly distributed between the lobes as illustrated. Cast elements (205, 207, 209) are not required to have a straight path through the cast material layer 202, for example, a cast element can extend parallel to a valley between each helical lobe (not shown) or adjacent a helical lobe (as shown in FIG. 2), so as to form a helical path. The alignment of a plurality of cast elements (205, 207, 209) in reference to each other, if a plurality of cast elements are present, to the longitudinal bore 210 of the tube 206, and/or the core 204 is not critical as they are not required to influence the thickness or shape of the resilient material layer 300.

In one embodiment, a cast element, for example conduit 205, is disposed in the void in such a manner as to create a gap between the conduit 205 and the longitudinal bore 210 of the tube 206 and/or between the conduit 205 and the outer surface 212 of the core 204. Such an arrangement can aid in the adhesion of the tube 206 and/or the core 204 to the cast material layer 202, respectively. In forming one embodiment, a cast element can lean against the outer surface 212 of the core 204. A cast element (205, 207, 209) can be affixed to a shallow helical groove or other surface irregularity (not shown) in the outer surface 212 of the core 204. Tube 206 itself can include a conduit 215, conductor 217, and/or pathway 219, which can be disposed at any location, e.g., adjacent to the peak of a lobe, in a valley between lobes, or anywhere therebetween. A conduit and/or pathway can be utilized as a fluidic bypass and/or for heating or cooling, for example, the passage of a heated or cooled fluid.

Alternatively or additionally, core 204 can include a pathway in the form of an internal bore 203. Internal bore 203 can extend the full axial length of the core. Internal bore 203 can house conduit(s) and/or conductor(s), if desired. Internal bore 203 can be threaded, if so desired. Longitudinal axis of internal bore 203 can be coaxial or offset from the longitudinal axis of the core 204. A plurality of internal bores can be included in core 204. Internal bore 203 can allow the passage of fluid therethrough.

Although illustrated in reference to the embodiment of FIG. 2, the above element(s) can be included in any embodiment of the invention. For example, an embodiment with a cast material outer surface, for example, the embodiment in FIG. 3, can include a conduit 205, conductor 207, and/or pathway 209 in the cast material layer 302 and/or core 304.

Figure 3:
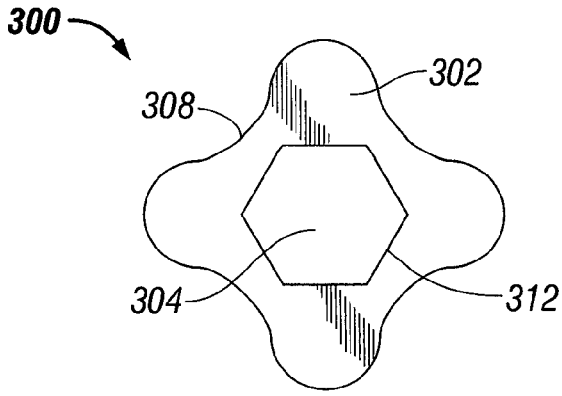
FIG. 3 is a perspective end view of a rotor having a cast material layer disposed on a core, according to one embodiment of the invention.

FIG. 3 is a perspective end view of a rotor 300 having a cast material layer 302 disposed on a core 304, according to one embodiment of the invention. Cast material layer 302 can be fully circumferential to the core 304, as shown. Outer surface of rotor 300 can be a profiled helical form, for example, as shown in FIG. 6. In one embodiment, outer surface 308 is a profiled helical outer surface formed directly in the cast material layer 302. As discussed below in reference to FIG. 8, a mold can be utilized to impart the profiled helical outer surface 308 into the cast material layer 302. Outer surface 308 of cast material layer 302 can be coated with a layer of material, for example, chrome or another metal or a resilient material coating. Outer surface 308 of cast material layer 302 can be coated by dipping, spraying, plating, electro-deposition, etc. Outer surface 308 of cast material layer 302 can be the active surface of the rotor 300. Layer 302 can be any cast material, as discussed above in reference to FIG. 2. Core 304 can be any shape and/or material, as also discussed above in reference to FIG. 2. Core 304 can add axial and/or rotational strength (e.g., rigidity) to the rotor 300. Outer surface 312 of core 304 can include at least one protuberance, for example, to serve as a mechanical interlock with cast material layer 302. Longitudinal axis of core 304 can be coaxial to the longitudinal axis of the rotor 300 and/or the cast material layer 302. A conduit and/or pathway (not shown) can be included in the cast material layer 302, for example, adjacent to the outer surface 308. Additionally or alternatively, a conduit 305 and/or pathway 309 can be disposed in the core 304, e.g., adjacent to the outer surface 312 of core 304. In the embodiment illustrated in FIG. 3, core 304 includes a conduit 305 and a pathway 309 disposed adjacent to the outer surface 312 of core 304. A plurality of pathways, conductors, and/or conduits can be disposed in the core 304 and/or cast material layer 302. A conduit 305 and/or pathway 309 can extend (e.g., in a straight line or helically) along an axial length of the rotor 300. In one embodiment, a conduit 305 and/or pathway 309 extend along an entire length of the rotor 300.

A conduit 305 and/or pathway 309 can be utilized as a fluidic bypass and/or heating or cooling, for example. In one embodiment, fluid, e.g., from the bore of a stator of a progressive cavity apparatus, can flow through a conduit and/or pathway in rotor 300 to cool the rotor and/or stator. A fluid can flow through a conduit 305 and/or pathway 309 in rotor 300 to provide a source of motive fluid from one end of a rotor to the opposing end. In one embodiment, a rotor, e.g., 300, 400, can be utilized in the power section of a progressive cavity motor. As there can be a pressure drop over the power section, a conduit and/or pathway in a rotor can be utilized to provide a bypass for a higher pressure fluid at one end (e.g., upstream) of the rotor to an opposing end (e.g., downstream). Bypass fluid can be utilized, for example, to steer a hydraulic steering actuator.

Figure 4:
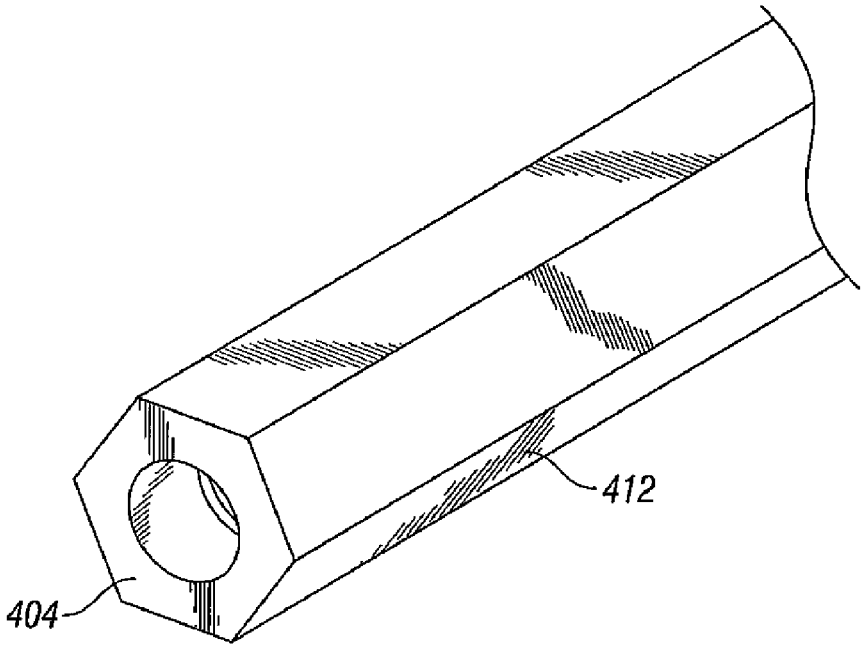
FIG. 4 is a perspective view of a core with an outer surface having a hexagonal transverse cross-section, according to one embodiment of the invention.

FIG. 4 is a perspective view of a core 404 with an outer surface 412 having a hexagonal transverse cross-section, according to one embodiment of the invention. In the embodiment depicted in FIG. 4, the outer surface 412 is non-helical (e.g., linear). Core 404 can included threads in an internal bore or other attachment means at an end(s) for connection to a progressive cavity apparatus.

Figure 5:
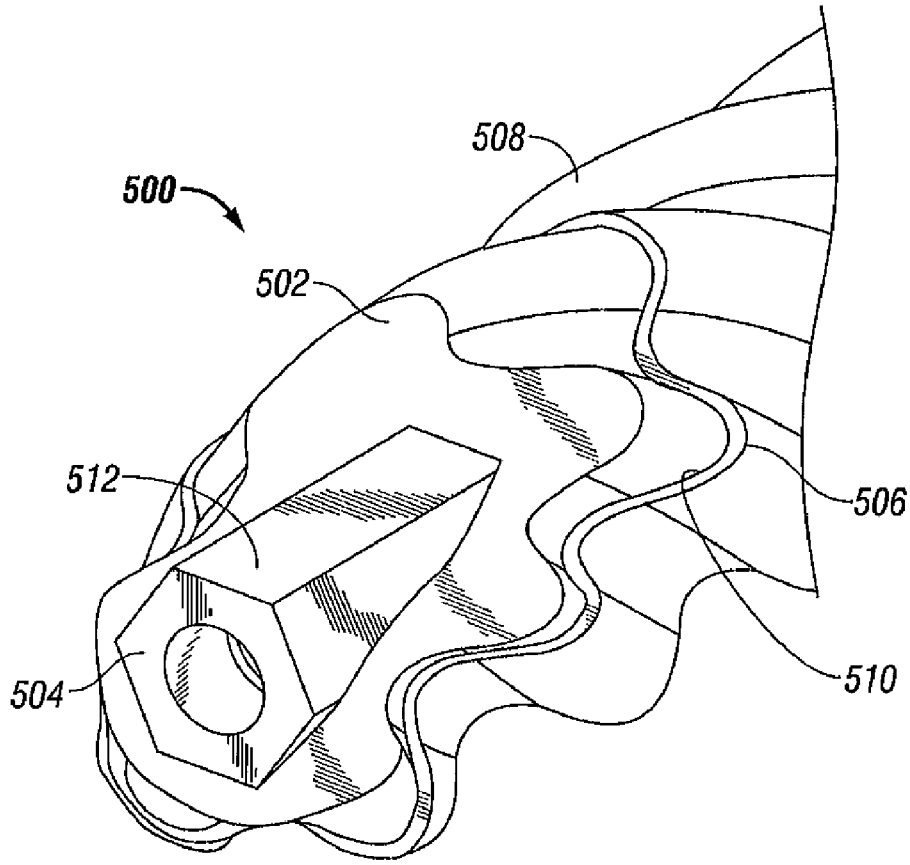
FIG. 5 is a cut-away perspective view of a rotor with a cast material layer between a core with a non-helical outer surface and a tube with a profiled helical inner surface and profiled helical outer surface, according to one embodiment of the invention.

FIG. 5 is a cut-away, for illustrative purposes, perspective view of a rotor 500 with a cast material layer 502 disposed between a non-helical outer surface 512 of a core 504 and a tube 506 with a profiled helical inner surface 510 and a profiled helical outer surface 508, according to one embodiment of the invention. Cast material layer 502 can conform to the profiled helical inner surface 510 (e.g., longitudinal bore) of the tube 506. Cast material layer 502 can provide structural support between the tube 506 and core 504. FIG. 6 is a perspective view of a profiled helical outer surface of a rotor 600, according to one embodiment of the invention.

Figure 7:
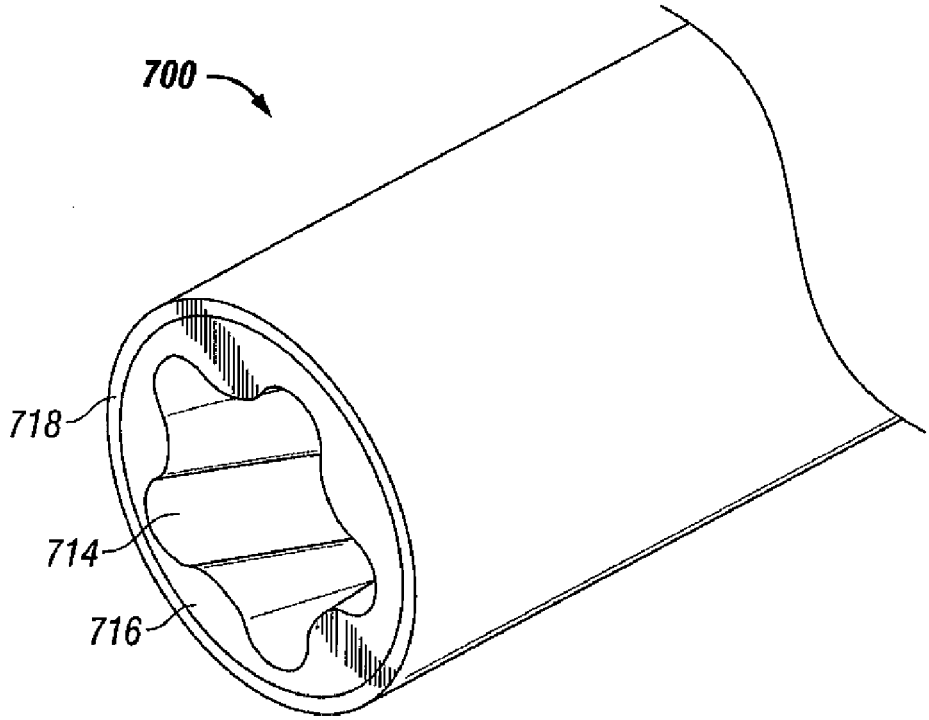
FIG. 7 is a perspective view of a mold with a profiled helical bore, according to one embodiment of the invention.

In one embodiment of the invention, a method of forming a rotor can include providing a mold with a profiled helical bore. FIG. 7 is a perspective view of a mold 700 with a profiled helical bore 714, according to one embodiment of the invention. A mold can be a negative mold, as is known the art. Profiled helical bore 714 of mold 700 can be selected to correspond to a desired shape for the outer surface of a rotor, e.g., profile (cross sectional shape) and pitch for the helix. A mold, or more particularly the profiled helical bore thereof, can be created, for example, by machining. A mold can be a single piece or a plurality of pieces, which can be longitudinally divided to allow release of a rotor from the mold. A mold can be created using conventional mold forming techniques. A mold, or more particularly, the profiled helical bore thereof, can be created by electrochemical machining (ECM), which employs electrical energy to remove material. ECM can be a de-plating process that utilizes the principles of electrolysis. A mold, or more particularly, the profiled helical bore thereof, can be created by electrical discharge machining (EDM) (e.g., spark erosion), which employs electrical energy to remove material. A pulsating high-frequency electric current is applied between an EDM tool and a workpiece, causing current to jump the gap and vaporize the material of the workpiece. EDM can produce shapes unobtainable by a conventional machining process.

A mold can itself be created by molding. For example, a body (e.g., a positive model of the profiled helical outer surface of a rotor) can be provided. A positive model can be an existing rotor. A positive model with a profiled helical outer surface can be inserted into a longitudinal bore of a body, for example, a longitudinal bore of a tube 718. A void between the profiled helical outer surface of the positive model and a longitudinal bore of a tube 718 can be filled with a cast material 716 in a fluid (which can include powdered material) state. Cast material 716 can be solidified, for example, by the application of pressure and/or heat and/or the passage of time. When the cast material 716 is sufficiently solidified, the positive model and/or tube 718 can be removed from the cast material 716, to expose the profiled helical bore 714 imparted into the cast material 716 to form mold 700. In one embodiment, cast material 716 can remain within the bore of tube 718, e.g., to strengthen mold 700 during use. Cast material 716 can be polyurethane or a resin, for example, epoxy. Cast material 716 used to create the mold 700 and cast material used in the cast material layer of a rotor can be different materials or the same. Profiled helical outer surface of positive model, for example, a rotor 800, can be coated with a release agent before filing the void with cast material to aid in the release of the positive model from the solidified cast material 714.

A rotor can be formed with or without the use of a mold with a profiled helical bore. In one embodiment, a mold 700 with a profiled helical bore 714 can be utilized. A core, for example, core 304 in FIG. 3, can be disposed longitudinally within the profiled helical bore 714 of mold 700. Core 304 can be coaxial to the profiled helical bore 714 of mold 700. Core can be substantially the same length as the profiled helical bore 714. Profiled helical bore 714 of mold 700 can be coated with a release agent, for example, before a cast material is disposed within a void between the profiled helical bore 714 of mold 700 and a core. End cap(s) (not shown) can be fitted to the end(s) of the mold 700 if desired to seal the mold 700, as is known in the art. Cast material can then be disposed into the void between the profiled helical bore 714 of mold 700 and a core, e.g., core 304, to form a cast material layer, for example, cast material layer 302 in FIG. 3. As disclosed above, cast material can be any material. Filling the void with a cast material can include injecting and/or pouring the cast material. Cast material can be a powdered solid which can be disposed in the void, melted to a fluid state, and then cured to a solid state. Solidifying cast material can include, for example, the application of radiation, pressure, a curing chemical, and/or heat and/or high pressure steam and/or the passage of time, or any combination of these. Cast material can have pressure applied thereto during filling and/or solidifying. Solidifying can include curing the cast material, as is known in the art. Solidifying a material does not necessarily refer to forming a relatively hard cast material. Cast material, for example, cast material layer 302 in FIG. 3, can adhere to a core, for example, core 304 in FIG. 3. In one embodiment, the solidifying (e.g., curing) of the cast material bonds the cast material layer 302 to the core 304 to provide a physical interface therebetween. For example, a thermosetting polymer cast material layer can adhere (e.g., bond) to a core, which can aid in transmitting torque and/or axial load. Additionally or alternatively, a bonding agent, for example, primer or an adhesive, can be utilized to adhere a cast material layer to a core and/or bore of a tube.

Figure 8:
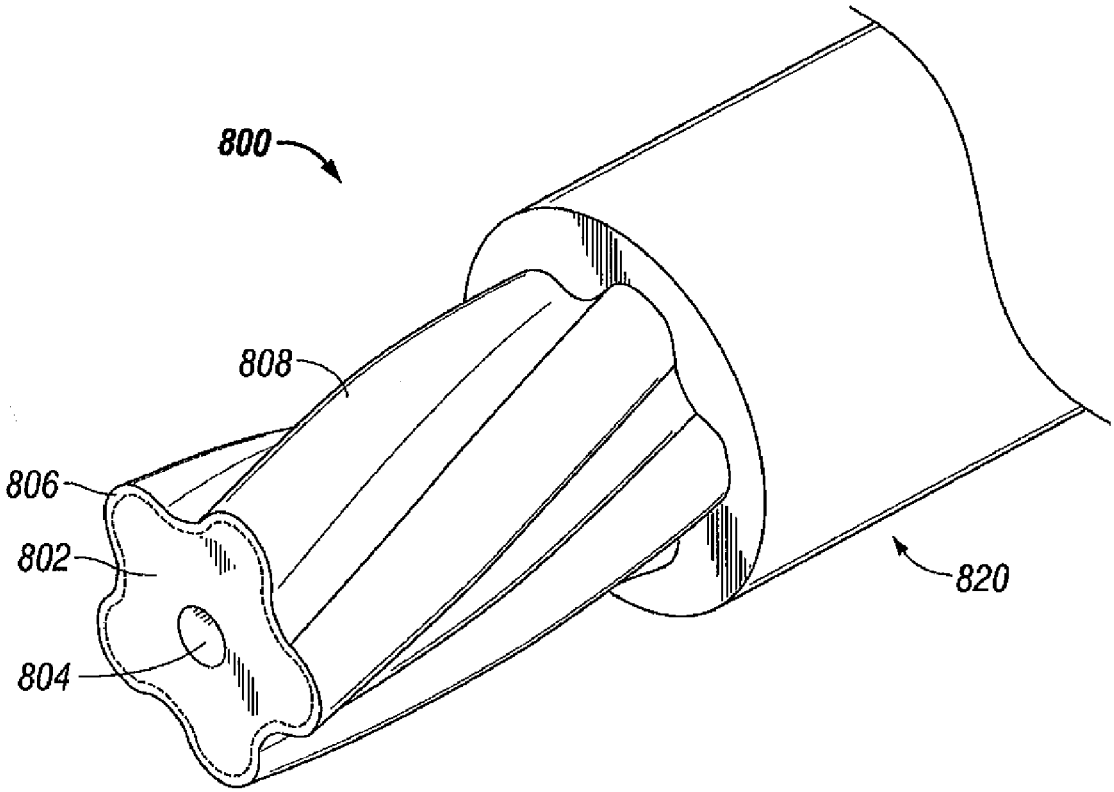
FIG. 8 is a perspective view of a rotor with a profiled helical outer surface being removed from a profiled helical bore of a mold, according to one embodiment of the invention.

Mold 700 can be removed from the rotor, for example, after the cast material has solidified. In one embodiment, the mold can be frangible and removed by breaking (e.g., shattering). In one embodiment, an assembly of the core and cast material can be threaded (e.g., axially and radially disposed) from the profiled helical bore of a mold, for example, as shown in FIG. 8. In such an embodiment, profiled helical outer surface 808 can be formed in cast material layer, which can be a unitary layer (802, 806). After removal from the profiled helical bore of mold 820, cast material outer layer 808 can be coated, for example, with chrome or any other metal or resilient material, if desired.

FIG. 8 is a perspective view of a rotor 800 with a profiled helical outer surface 808 being removed from a profiled helical bore of a mold 820, according to one embodiment of the invention. In one embodiment, a tube can be disposed circumferential to cast material layer, for example as shown in FIGS. 2, 5, and 8.

Figure 9:
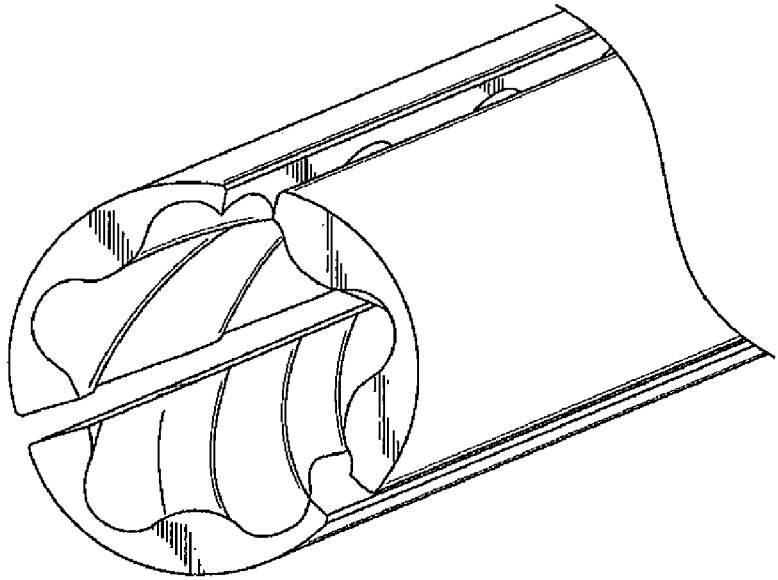
FIG. 9 is a perspective view of a longitudinally divided mold with a profiled helical bore, according to one embodiment of the invention.

FIG. 9 is a perspective view of a longitudinally divided mold 920 with a profiled helical bore, according to one embodiment of the invention. Mold 920 can include a plurality of sections, which can be divided transverse to the longitudinal axis of the mold (not shown), or longitudinally divided (as shown in FIG. 9). Mold 920 can be a unitary piece or divided into sections. Mold 920 can include any plurality of divided sections. Mold 920 illustrated in FIG. 9 includes three longitudinally divided sections (920A, 920B, 920C). Dividing a mold 920 longitudinally can allow release of a rotor molded therein, e.g., according to a method of this invention, which can be interlocked into the mold 920 during solidification due to the nature of the lobed profile.

Referring again to FIG. 5, one method of forming a rotor 500 having a cast material layer 502 disposed between a tube 506 and core 504 can be described. As noted above, a tube can be any material. In one embodiment, a tube 506 is provided having a non-profiled and/or non-helical form, for example, a tube with a cylindrical outer surface and cylindrical inner surface (e.g., longitudinal bore). A tube with a non-profiled helical outer surface can be utilized. Such a tube can disposed with a profiled helical bore of a mold, for example mold 700 in FIG. 7. Outer surface of a tube, which may or may not have a profiled helical form, can then be conformed to the profiled helical bore 714 of the mold 700 to impart a profiled helical form to the tube. Tube can be at least partially uncured, for example, during the conforming step. In one embodiment, a tube can be an elastomer, e.g., in at least a partially uncured state. Outer surface of a tube can be conformed by hydroforming the tube directly within the profiled helical bore 714 of a mold 700. Hydroforming, also referred to as hydromolding, can include pressurizing a longitudinal bore of a tube with a hydraulic fluid to force the tube into the shape of the profiled helical bore. A hydraulic fluid can be the cast material in the fluid state.

In one embodiment a tube, e.g., with a cylindrical inner and outer surface, can be disposed within the profiled helical bore 714 of a mold 700; and the filling of a void 502 between an outer surface 512 of a core 504 and the longitudinal bore 510 of a tube 506 with cast material can concurrently dispose the outer surface 508 of the tube 506 into contact with the profiled helical bore 714 of the mold 700, and thus conform the outer surface 508 of the tube 506 into a profiled helical form of a rotor 500. End caps (not shown) can be included on the tube and/or mold 700 to retain pressure and/or cast material. End cap can be included to retain the core in a desired radial and/or axial location within the tube, for example, until the cast material solidifies.

Outer surface of a tube can be conformed to the profiled helical bore 714 of a mold 700 by twisting and/or imparting axial compression and/or tension to the tube. Outer surface of a tube can be conformed to the profiled helical bore 714 of a mold 700 by pulling suction between the outer surface of the tube and the profiled helical bore 714 of a mold 700. Adhesive or other fastener can be utilized to affix a portion of a tube to a profiled helical bore of a mold, for example, until a cast material solidifies.

A tube with a pre-formed profiled helical outer surface can be utilized. In one embodiment, this pre-formed profiled helical outer surface (e.g., FIG. 6) is disposed within a profiled helical bore of a mold. The profiled helical bore of a mold can have a substantially similar form (e.g., pitch, cross-sectional profile, etc.) to the profiled helical outer surface of a tube. Tube with pre-formed profiled helical outer surface can be threadably engaged within a profiled helical bore of a mold. A profiled helical bore of a mold disposed adjacent to the profiled helical outer surface of a tube can provide support to the tube, for example, to impede deformation of the tube during the filling of the tube with a cast material. Tube can have a longitudinal bore of any geometry, including cylindrical outer surface (not shown) or a profiled helical inner surface as shown in FIG. 5. Tube can be of uniform thickness, or can be of variable thickness, for example, thicker at the peak of each lobe or thicker at a valley between each lobe, as is known in the art. In one embodiment, using a preformed tube, instead of injection molding the tube onto a core, for example, can allow precision control over the thickness of the tube. A preformed tube that has an inner cast material layer filled after formation can allow more precise control over the dimensions of that outer preformed tube as well as a forming a bond between the tube and cast material, as opposed to merely coating a cast material with a layer of material.

In one embodiment, when an outer surface 808 of a tube 806 (inner boundary shown with a dotted line) has a profiled helical form (e.g., FIG. 6) and is disposed in the profiled helical bore of a mold 820, a core 804 can be disposed within a longitudinal bore of the tube 806. A void between the outer surface of the core 804 and the longitudinal bore of the tube 806 can be filled with a cast material to form cast material layer 802. Cast material layer 802 can be solidified, which can include curing with heat or other energy. Tube 806 can be at least partially uncured before the solidifying of the cast material layer 802. Solidifying, for example, curing with heat or other energy, can serve to concurrently solidify (e.g., cure) an at least partially uncured tube 806 and an at least partially uncured cast material 802. Assembly of core 804, cast material layer 802, and tube 806 can be removed from the profiled helical bore of the mold 820. At least one of the profiled helical bore of mold 820 and outer surface 808 of tube 806 can have a release agent applied thereto. Assembly of core 804, cast material layer 802, and tube 806 can be removed by threading out of the profiled helical bore of the mold 820, for example, if the mold 820 is a single piece as depicted in FIG. 8. Section of rotor 800 is shown protruding from the profiled helical bore of the mold 820 in FIG. 8, which can be during threaded removal from the mold 820, for example.

Referring to FIG. 5 once again, another embodiment a rotor 500 having a profiled helical outer surface 506 can be described. A tube 506 can be provided having a preformed profiled helical outer surface 508. Tube 506 is depicted with a profiled helical inner surface 510, but the longitudinal bore 510 of tube 506 can have any form, for example, cylindrical. Longitudinal bore 510 of tube 506 and/or outer surface 512 of core 504 can have a transverse cross-section that is circular or non-circular and can be linear or helical along the longitudinal length. Non-circular transverse cross-section can be ovate, a closed figure including curved and straight line segment(s), triangular, rectangular, square, hexagonal, or other polygonal.

Core 504 can be disposed longitudinally with the bore 510 of the tube 506. Cast material can then be disposed between the core 504 and the tube 506 with the profiled helical outer surface 506. Alternatively, cast material can be disposed within the longitudinal bore 510 of the tube 506, and then core 504 can be disposed into cast material. In one embodiment, no mold is disposed adjacent the outer surface 506 of the tube for support. After the cast material layer 502 solidifies, the rotor 500 can be utilized as is, or the outer surface 508 of the tube 506 can be coated. If further adhesion between a core and a cast material is desired, surface roughing or a bonding agent, for example a primer, can be applied to the exterior surface of the core and/or to the interior surface of a tube (if present). At least one groove (not shown) can be machined into the exterior surface of a core and/or interior surface of the longitudinal bore of the tube (if present) to provide a mechanical lock between the cast material and the core and/or tube (if present).

Numerous embodiments and alternatives thereof have been disclosed. While the above disclosure includes the best mode belief in carrying out the invention as contemplated by the named inventors, not all possible alternatives have been disclosed. For that reason, the scope and limitation of the present invention is not to be restricted to the above disclosure, but is instead to be defined and construed by the appended claims.

What is claimed is:

1. A method of forming a rotor comprising:

providing a mold with a profiled helical bore by:

disposing a first body with a profiled helical outer surface into a longitudinal bore of a second body;

filling a void between the profiled helical outer surface of the first body and the longitudinal bore of the second body with a second cast material in a fluid state;

solidifying the second cast material to impart the profiled helical bore into the second cast material; and removing the first body from the profiled helical bore in the second cast material to create the mold with the profiled helical bore;

inserting a resilient tube into the profiled helical bore;

conforming the resilient tube to the profiled helical bore;

disposing a core within the profiled helical bore;

filling a void between an outer surface of the core and the resilient tube in the mold with a cast material in a fluid state;

solidifying the cast material to impart a profiled helical outer surface into the cast material and into the resilient tube; and removing the mold to present a rotor with the core surrounded by the cast material which, in turn, is surrounded by the resilient tube.

2. The method of claim 1 further comprising applying a release agent to the profiled helical bore in the mold before filling the void with the cast material.

3. The method of claim 1, wherein the removing step comprises threading an assembly of the cast material and the core out of the profiled helical bore in the mold to remove the assembly from the mold.

4. The method of claim 1 wherein the mold comprises a single piece.

5. The method of claim 1 wherein the mold comprises a plurality of longitudinally divided sections.

6. The method of claim 1 wherein the second cast material comprises a resin.

7. The method of claim 6 wherein the resin comprises an epoxy.

8. The method of claim 1 wherein the second cast material comprises a polyurethane.

9. The method of claim 1 further comprising applying a release agent to the profiled helical outer surface of the first body before filling the void between the profiled helical outer surface of the first body and the longitudinal bore of the second body with the second cast material.

10. The method of claim 1 wherein the first body comprises an existing rotor.

11. The method of claim 1 further comprising imparting pressure on the cast material after filling the void.

12. The method of claim 1 wherein solidifying the cast material comprises applying at least one of heat and steam to the cast material.

13. The method of claim 1 wherein solidifying the cast material adheres the cast material to the core.

14. The method of claim 1 wherein the outer surface of the core has a circular transverse cross-section.

15. The method of claim 1 wherein the outer surface of the core has a non-circular transverse cross-section.

16. The method of claim 1 wherein the outer surface of the core has at least one protuberance.

17. The method of claim 1 wherein the core comprises a metal.

18. The method of claim 1 wherein the cast material comprises a polymer.

19. The method of claim 18 wherein the polymer comprises a thermoplastic polymer.

20. The method of claim 18 wherein the polymer comprises a thermosetting polymer.

21. The method of claim 18 further comprising selecting the polymer having a glass transition temperature above an operating temperature of the rotor.

22. The method of claim 1 further comprising imparting a pathway in the core.

23. The method of claim 1 further comprising imparting a pathway in the cast material.

24. The method of claim 1 further comprising disposing into the void at least one non-stick mandrel extending from a proximal end of the void to a distal end of the void before the cast material solidifies.

25. The method of claim 24 further comprising removing the at least one non-stick mandrel after allowing the cast material to solidify to form a pathway in the cast material.

26. The method of claim 1 further comprising disposing at least one conductor in the cast material.

27. The method of claim 1 further comprising disposing into the void at least one conductor extending from a proximal end of the void to a distal end of the void before the cast material solidifies.

28. The method of claim 1 further comprising disposing at least one conductor in the core.

29. The method of claim 1 further comprising disposing at least one conduit in the cast material.

30. The method of claim 1 further comprising disposing into the void at least one conduit extending from a proximal end of the void to a distal end of the void before the cast material solidifies.

31. The method of claim 1 further comprising disposing at least one conduit in the core.

32. A method of forming a rotor comprising:

providing a tube having a longitudinal bore and a profiled helical outer surface;

positioning the tube within a mold having an internal helical profile;

disposing a core within the longitudinal bore of the tube;

filling a void between an outer surface of the core and the longitudinal bore of the tube with a cast material in a fluid state;

solidifying the cast material;

securing the tube to the cast material to form the rotor; and imparting a pathway in a wall of the tube.

33. The method of claim 32 wherein solidifying the cast material adheres the cast material to the core and the tube.

34. The method of claim 32 wherein solidifying the cast material comprises applying at least one of heat and steam to the cast material.

35. The method of claim 32 further comprising imparting pressure on the cast material after filling the void.

36. The method of claim 32 wherein the tube comprises a resilient material.

37. The method of claim 32 wherein the tube comprises a metal.

38. The method of claim 32 wherein the core comprises a metal.

39. The method of claim 32 wherein the outer surface of the core has a circular transverse cross-section.

40. The method of claim 32 wherein the outer surface of the core has a non-circular transverse cross-section.

41. The method of claim 32 wherein the outer surface of the core has at least one protuberance.

42. The method of claim 32 further comprising imparting pressure on the cast material after filling the void and disposing the tube within the profiled helical bore in the mold.

43. The method of claim 32 further comprising imparting a pathway in the core.

44. The method of claim 32 further comprising imparting a pathway in the cast material.

45. The method of claim 32 further comprising disposing into the void at least one non-stick mandrel extending from a proximal end of the void to a distal end of the void before the cast material solidifies.

46. The method of claim 45 further comprising removing the at least one non-stick mandrel after allowing the cast material to solidify to form a pathway in the cast material.

47. The method of claim 32 further comprising disposing at least one conductor in the cast material.

48. The method of claim 32 further comprising disposing into the void at least one conductor extending from a proximal end of the void to a distal end of the void before the cast material solidifies.

49. The method of claim 32 further comprising disposing at least one conductor in a wall of the tube.

50. The method of claim 32 further comprising disposing at least one conductor in the core.

51. The method of claim 32 further comprising disposing at least one conduit in the cast material.

52. The method of claim 32 further comprising disposing into the void at least one conduit extending from a proximal end of the void to a distal end of the void before the cast material solidifies.

53. The method of claim 32 further comprising disposing at least one conduit in a wall of the tube.

54. The method of claim 32 further comprising disposing at least one conduit in the core.

55. A method of forming a rotor comprising:

inserting a tube having a longitudinal bore and an outer surface into a mold with a profiled helical bore, the outer surface initially being cylindrical;

conforming the outer surface of the tube to the profiled helical bore in the mold by pulling suction between the outer surface of the tube and the profiled helical bore in the mold;

disposing a core within the longitudinal bore of the tube;

filling a void between an outer surface of the core and the longitudinal bore of the tube with a cast material in a fluid state;

solidifying the cast material to form a rotor with a combined core, cast material, and tube in which the cast material is secured to the core and the tube is secured to the cast material; and removing the mold from the tube to expose a profiled helical outer surface of the tube.

56. The method of claim 55 wherein the step of conforming the outer surface of the tube to the profiled helical bore in the mold comprises hydroforming the tube to the profiled helical bore in the mold.

57. The method of claim 55 wherein the step of filling the void with the cast material in the fluid state conforms the outer surface of the tube to the profiled helical bore in the mold.

58. The method of claim 55 wherein the step of conforming the outer surface of the tube to the profiled helical bore in the mold comprises twisting and imparting axial compression to the tube.

59. The method of claim 55 wherein solidifying the cast material adheres the cast material to the outer surface of the core and the longitudinal bore of the tube.

60. The method of claim 55 further comprising applying a release agent to at least one of the profiled helical bore in the mold and the outer surface of the tube before conforming the outer surface of the tube to the profiled helical bore in the mold.

61. The method of claim 55 further comprising imparting pressure on the cast material after filling the void.

62. The method of claim 55 wherein solidifying the cast material comprises applying at least one of heat and steam to the cast material.

63. The method of claim 55 wherein a maximum diameter of the outer surface of the tube is less than a minimum diameter of the profiled helical bore in the mold before the conforming step.

64. A method of forming a rotor comprising:

inserting a tube having a longitudinal bore and an outer surface into a mold with a profiled helical bore, the outer surface initially being cylindrical;

conforming the outer surface of the tube to the profiled helical bore in the mold;

disposing a core within the longitudinal bore of the tube;

filling a void between an outer surface of the core and the longitudinal bore of the tube with a cast material in a fluid state;

solidifying the cast material to form a rotor with a combined core, cast material, and tube in which the cast material is secured to the core and the tube is secured to the cast material; and removing the mold from the tube to expose a profiled helical outer surface of the tube, wherein a maximum diameter of the outer surface of the tube is greater than a minimum diameter of the profiled helical bore in the mold before the conforming step.

65. The method of claim 64 wherein a peripheral length of the outer surface of the tube is substantially equal to a peripheral length of the profiled helical bore in the mold.

66. The method of claim 55 wherein the outer surface of the core has at least one protuberance.

67. The method of claim 64 wherein the core comprises a metal.

68. The method of claim 55 wherein the tube comprises a metal.

69. The method of claim 55 further comprising coating the profiled helical outer surface of the tube with a metal.

70. The method of claim 55 wherein the cast material comprises a polymer.

71. The method of claim 70 wherein the polymer comprises a thermoplastic polymer.

72. The method of claim 70 wherein the polymer comprises a thermosetting polymer.

73. The method of claim 70 further comprising selecting the polymer having a glass transition temperature above an operating temperature of the rotor.

74. A method of forming a rotor comprising:

inserting a tube having a longitudinal bore and an outer surface into a mold with a profiled helical bore, the outer surface initially being cylindrical;

conforming the outer surface of the tube to the profiled helical bore in the mold;

disposing a core within the longitudinal bore of the tube;

filling a void between an outer surface of the core and the longitudinal bore of the tube with a cast material in a fluid state;

solidifying the cast material to form a rotor with a combined core, cast material, and tube in which the cast material is secured to the core and the tube is secured to the cast material; and removing the mold from the tube to expose a profiled helical outer surface of the tube, wherein the tube comprises a resilient material and wherein the resilient material is not fully cured before the solidifying step.

75. The method of claim 74 wherein solidifying the cast material comprises applying at least one of heat and steam to the cast material and the at least partially uncured resilient material.

76. The method of claim 75 wherein the at least one of heat and steam cures the resilient material.

77. The method of claim 74 further comprising curing the resilient material before removing the mold from the tube.

78. The method of claim 74 further comprising imparting a pathway in a wall of the tube.

79. The method of claim 74 further comprising imparting a pathway in the core.

80. The method of claim 74 further comprising imparting a pathway in the cast material.

81. The method of claim 74 further comprising disposing into the void at least one non-stick mandrel extending from a proximal end of the void to a distal end of the void before the cast material solidifies.

82. The method of claim 81 further comprising removing the at least one non-stick mandrel after allowing the cast material to solidify to form a pathway in the cast material.

83. The method of claim 74 further comprising disposing at least one conductor in the cast material.

84. The method of claim 74 further comprising disposing into the void at least one conductor extending from a proximal end of the void to a distal end of the void before the cast material solidifies.

85. The method of claim 74 further comprising disposing at least one conductor in a wall of the tube.

86. The method of claim 74 further comprising disposing at least one conductor in the core.

87. The method of claim 74 further comprising disposing at least one conduit in the cast material.

88. The method of claim 74 further comprising disposing into the void at least one conduit extending from a proximal end of the void to a distal end of the void before the cast material solidifies.

89. The method of claim 74 further comprising disposing at least one conduit in a wall of the tube.

90. The method of claim 74 further comprising disposing at least one conduit in the core.

91. The method of claim 1, wherein the cast material comprises a powdered metal.

92. The method of claim 32, wherein the cast material comprises a powdered metal.

93. The method of claim 55, wherein the cast material comprises a powdered metal.

* * * * *